United States Patent [19]

Allgeyer et al.

[11] 4,135,369

[45] Jan. 23, 1979

[54] DUAL TEMPERATURE MERCHANDISER

[75] Inventors: David F. Allgeyer; Donald A. Musgrave; Lester F. Reifeiss, all of Conway, Ark.

[73] Assignee: UMC Industries, Inc., Stamford, Conn.

[21] Appl. No.: 834,235

[22] Filed: Sep. 19, 1977

[51] Int. Cl.[2] ..... A47F 3/04; F25D 13/02

[52] U.S. Cl. ..... 62/251; 62/252; 62/254; 62/442

[58] Field of Search ..... 62/246, 252, 441, 442, 62/251, 254, 250

[56] References Cited

U.S. PATENT DOCUMENTS

| | | | |
|---|---|---|---|
| 1,979,625 | 11/1934 | Knapp | 62/254 |
| 1,981,298 | 11/1934 | Banta | 62/254 |
| 2,163,031 | 6/1939 | Goalstone | 62/254 |
| 2,529,384 | 11/1950 | Greiling | 62/252 |
| 2,594,066 | 4/1952 | Pabst | 62/252 |
| 2,610,479 | 9/1952 | Iwashita | 62/442 |
| 2,936,596 | 5/1960 | Rainwater | 62/254 |
| 2,952,992 | 9/1960 | Voorhies | 62/251 |

*Primary Examiner*—Lloyd L. King
*Attorney, Agent, or Firm*—Paul M. Denk

[57] ABSTRACT

A dual temperature merchandiser incorporating both upper and lower communicating compartments, the upper compartment for chilling food products, with the lower compartment disposed for holding frozen food products, a single refrigeration unit incorporating the condenser and compressor are provided for maintaining the chilled and freezing temperatures within their respective compartments, and evaporators operatively associated and rendered functional by the aforesaid condenser and compressor being provided within each of the compartments, thermostatic controls responsive to the temperatures maintained within each compartment a valve operatively associated with the thermostatic control maintained in the upper chilling compartment and providing for the flow, or curtailment thereof, of refrigerant through the evaporator maintained within said compartment for independently maintaining the chilling temperature therein, regardless of the continued transfer of refrigerant through the lower compartment and sustaining of the freezing temperature therein; the evaporator contained in the lower compartment being formed of a series of coils, and a portion of said coils being arranged adjacent the lower compartment walls for enhancing the efficiency of its refrigeration.

30 Claims, 9 Drawing Figures

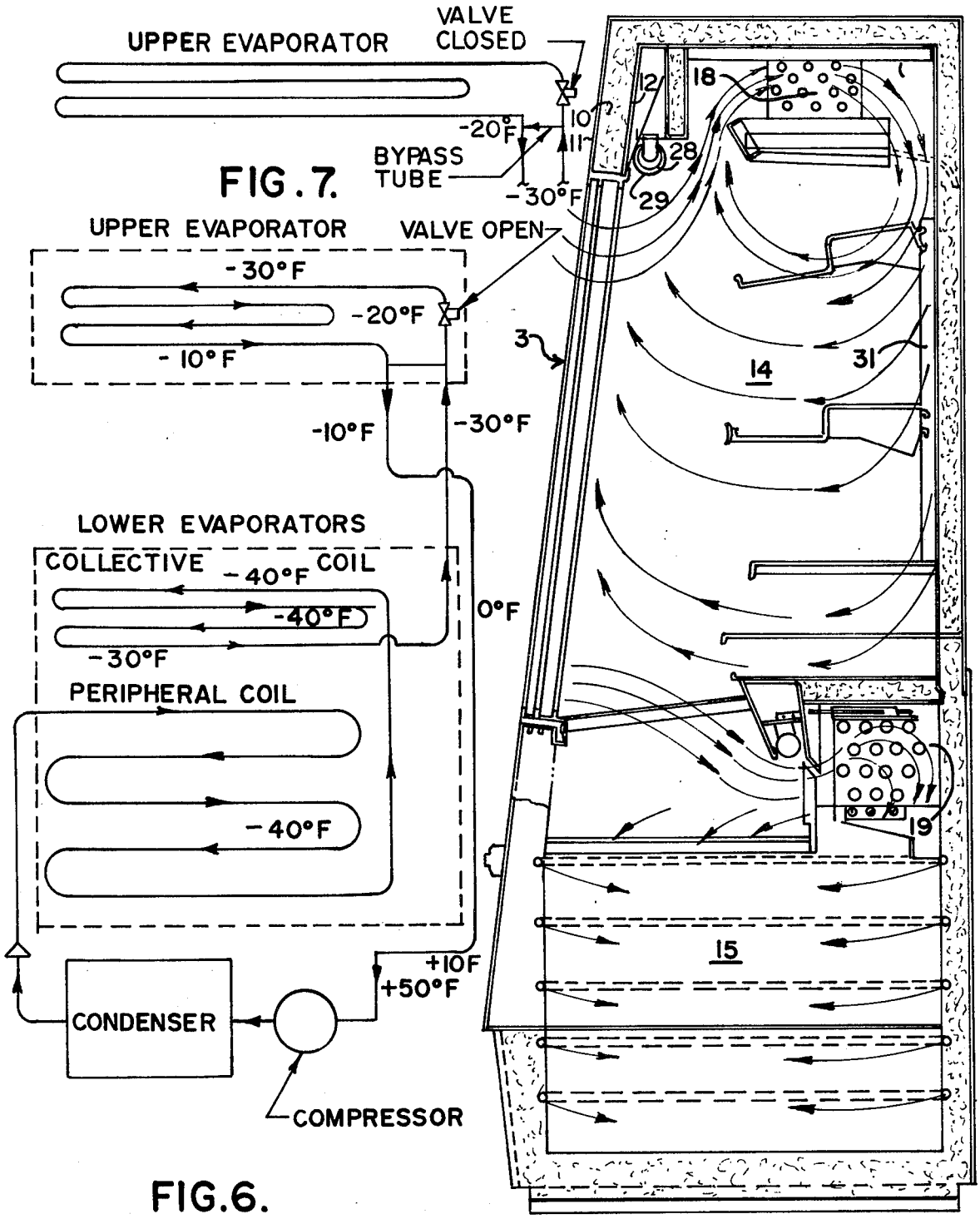
FIG. 7.
FIG. 6.
FIG. 8.
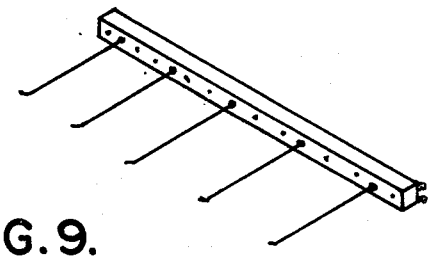
FIG. 9.

DUAL TEMPERATURE MERCHANDISER

BACKGROUND OF THE INVENTION

This invention relates generally to a refrigeration apparatus, and more specifically pertains to a dual compartment with independent temperature maintenance through the cooperation of select thermostatic controls and valve means.

Innumerable styles of refrigerated display cases are available in the prior art. For example, such cases usually incorporate an insulated housing containing a variety of shelves and having either access means in the form of doors, such as pivotal or sliding doors, enclosing the compartment, or even being of the open display case type wherein the reach-in portion of the case remains permanently opened, relying upon the heavier specific gravity of chilled air to remain cradled within the lower reaches of the compartment so as to prevent its escape through heat dissipation.

Usually, though, such display cases incorporate a variety of refrigeration means, as for example, independent refrigeration means for each portion or compartment of the case where varying temperatures may be desired, if multi temperatures are included. For example, in the U.S. Pat. to Knapp, No. 1,979,625, there is disclosed a dual temperature display case which is used for preserving supplies in a frozen condition, and at the same time, maintain the storage and display of foods at normal refrigerated temperatures. And, to achieve such, a variety of refrigerant evaporators are rendered functional from either a single or separate compressor-condenser structures, without the use of independent control, so therefore, when a temperature within one compartment as mentioned may exceed the desirable limit, the refrigerating apparatus is initiated so as to lower that temperature to that desired, without regard for the fact that the temperature within the other section may already be located at its preferred level. To remedy this problem, the U.S. Pat. to Sanders, No. 3,010,291, discloses a refrigerating apparatus wherein its above-freezing and sub-freezing compartments are independently cooled by separate refrigerating means, which may provide the preferred control for the separate temperature maintenance, but because of the necessity for utilizing independent refrigerating means to do so, the cost of such a unit is greatly enhanced through this redundancy.

Various other styles of refrigerated display cases incorporate the use of a plurality of evaporators, for maintaining temperatures within various sections of the case, but usually, such evaporators are generally rendered functional by an independent refrigerating means, without independent control of the flow of the refrigerant simultaneously to all of its accompanying evaporators. This is shown in the U.S. Pat. to Burtis, No. 2,490,413. Other refrigerating display cases of this type are shown in the U.S. Pat. to Banta, Nos. 1,981,298, Spangler, No. 2,495,554 and Warren, No. 2,501,459.

In view of the foregoing, it is the principal object of this invention to provide a dual temperature merchandiser having independent refrigerant flow to discrete evaporators located within separate but communicating compartments of the merchandiser, wherein temperatures may be precisely regulated through independent thermostatic and valve controls.

Another object of this invention is to provide a dual temperature merchandiser wherein the chilling temperatures approximating 35° F. may be precisely regulated within its upper compartment while the overflow from said compartment will blanket and assist in sustaining a freezing temperature within the vicinity of a −10° F. within the lower compartment, while the same refrigerating apparatus may selectively operate to decrease the subzero temperature within this lower compartment and hold it at its desired lower level.

A further object of this invention is to provide a dual temp merchandiser wherein its subfreezing lower temperature is selectively and efficiently maintained due to the location of evaporator coils conveniently surrounding the walls of the said compartment.

Another object of this invention is to provide a means for properly controlling the temperature interface between a refrigerating compartment and a subfreezing compartment maintained therebelow through the usage of conveniently located frost breakers.

A further object of this invention is to provide the construction of a dual temperature merchandiser wherein a significantly sized access aperture into the compartment is conveniently arranged adjacent the refrigerating compartment, but yet furnishes convenient access within the standard reach into a lower disposed subfreezing compartment wherein frozen foods or other products may be stored and displayed.

Yet another object of this invention is the provision of a variety of shelving for use within a dual temperature merchandiser and which are readily replaceable, adding to the convenience and prompt display of refrigerated products at the market.

Still another object of this invention is to provide means for illuminating a dual temperature merchandiser wherein conveniently disposed lighting not only brightens its display area, but also can be used for lighting a display for advertising the selection of the merchandiser.

Still another object of this invention is to provide convenience in the disposition of the compressor and condenser of the refrigerating means, making it readily accessible through its mounting upon a removable tray that can be conveniently slid forwardly of the merchandiser and readily serviced by the mechanic.

These and other objects will become more apparent to those skilled in the art upon reviewing the summary of this invention, and upon undertaking a study of the description of its preferred embodiment in view of the accompanying drawings.

SUMMARY OF THE INVENTION

This invention contemplates the structure of a dual temperature merchandiser which has added convenience inherently built into it due to its unique construction, being formed having freely communicating upper and lower compartments, with the upper compartment being designed for the holding and display of refrigerated products, such as those type of food products customarily requiring a temperature in the vicinity of slightly above freezing, as at 35° F., while the lower compartment of the display case has ample room for holding a large capacity of frozen foods, such as those which may be maintained in the vicinity of 0° F., or below, and either stored therein, or readily displayed for customer selection. More specifically, the essence of the invention pertains to the novel refrigerating controls utilized for precisely maintaining the desired temperatures within the dual compartments, and as can be seen in FIG. 6, the merchandiser is designed for functioning from a single combination of a condenser and compressor, which may be disposed within the lowermost region of the case, and with the refrigerant flow circuitry of the system feeding a plurality of evaporators that are precisely located at those specific positions within the display case where it has been found to provide the highest accuracy of temperature regulation and maintenance within the operating case. For example, and as can be seen in said FIG. 6, an upper evaporator is coupled to the aforesaid refrigerating devices, and likewise is in communication, in series, with a pair of series arranged evaporators normally disposed within the lower compartment of the merchandiser. The lower evaporators include a collective coil evaporator that is arranged just above the upper region of the lower compartment wherein the subfreezing temperatures are desirably maintained, while a series of peripheral coils are provided for lining the lower compartment walls and therein effectively produce a conductive cooling of the frozen food product maintained therein. Valve means, as can be seen associated with the upper evaporator, is provided for introducing the upper evaporator into the refrigerating system, and likewise, upon closure of said valve, as can be seen in FIG. 7, effects a bypass of any refrigerant flowing through the shown flow lines so that only the evaporators of the lower compartment may be functioning when it is desired to only achieve a lowering of the selected freezing temperature within the lower compartment, presuming that the chilling temperature maintained within the upper compartment is established and maintained at a satisfactory level. Thermostatic controls, as can be seen in FIG. 5, provide for the selective flow of refrigerant from the operating refrigerating unit, that is, its compressor and condenser, so that when it is necessary to provide for a lowering of the temperature within the lower compartment to the desired subfreezing level, as between 0° F. to a −40° F., the lower thermostatic control will close, as when a temperature above the aforementioned is encountered, thereby providing for the flow of refrigerant through the lower evaporators, as previously explained with regard to FIG. 6. But, at the same time, if the temperature within the upper compartment is properly maintained at the selected chilling level, as between 25° F. to 40° F., as may be desired, the upper thermostatic control may not be initiated, and will thereby maintain the valve, which may comprise a solenoid valve, in a closed position, as shown in said FIG. 7, and thereby effect a bypassing of the refrigerant past the upper evaporator, and cause only a lower temperature influence within the evaporators associated with the lower compartment. On the other hand when the temperature within the upper compartment requires a decrease, as when the temperature may rise above the selected chilling level, such as above 35° F., then the upper thermostatic control initiates an opening of the solenoid valve, and also energizes the refrigerating unit into operation thereby causing a flow of the refrigerant through the upper evaporator, in addition to its series arranged lower evaporators, in a manner as shown and as previously explained in FIG. 6. Under this condition, the refrigerant is not allowed to bypass the upper evaporator, but rather, flows through both the upper evaporator and the lower evaporators, until such time as the temperature within the upper compartment may reach the desired and selected chilling level. Thus, as can be summarized, the chilling temperature desired to be maintained within the upper compartment of the merchandiser can be independently controlled by the upper thermostatic control, and its associated valve, but in addition, the lower thermostatic control can likewise initiate a functioning of the refrigerating apparatus so as to effect a flow or refrigerant through just the lower evaporators, as when it is desired to decrease the temperature only within the lower compartment. Obviously, under this particular refrigeration control circuitry, while the upper evaporator is functioning, since it is maintained in series with the evaporators maintained within the lower compartment, the latter evaporators will likewise receive the flow of refrigerant thereto, and therethrough, so that when the upper compartment is being lowered in temperature, the lower compartment will be subjected to a similar function. But, the selectivity in the functional and related operations of the upper and lower evaporators, due to their integrated circuitry, provides a precisely regulated means for all of the evaporators functioning from a single refrigerating unit.

BRIEF DESCRIPTION OF THE DRAWINGS

In the drawings,

FIG. 6 discloses a refrigerant flow diagram for the refrigerating unit of this invention, disclosing the normally open condition for the valve means of the upper evaporator;

FIG. 7 furnishes a partial view of the refrigerant flow diagram disclosing the closed condition for the valve means of the upper evaporator;

FIG. 8 furnishes a similar sectional view as that shown in FIG. 2 and providing a schematic display of the air flow patterns of the ambient and refrigerated air passing into and maintained within the operating merchandiser; and FIG. 9 disclosed a peg bar for use in supporting displayed products preferably in the upper compartment of the case.

DESCRIPTION OF THE PREFERRED EMBODIMENT

Figure 1:
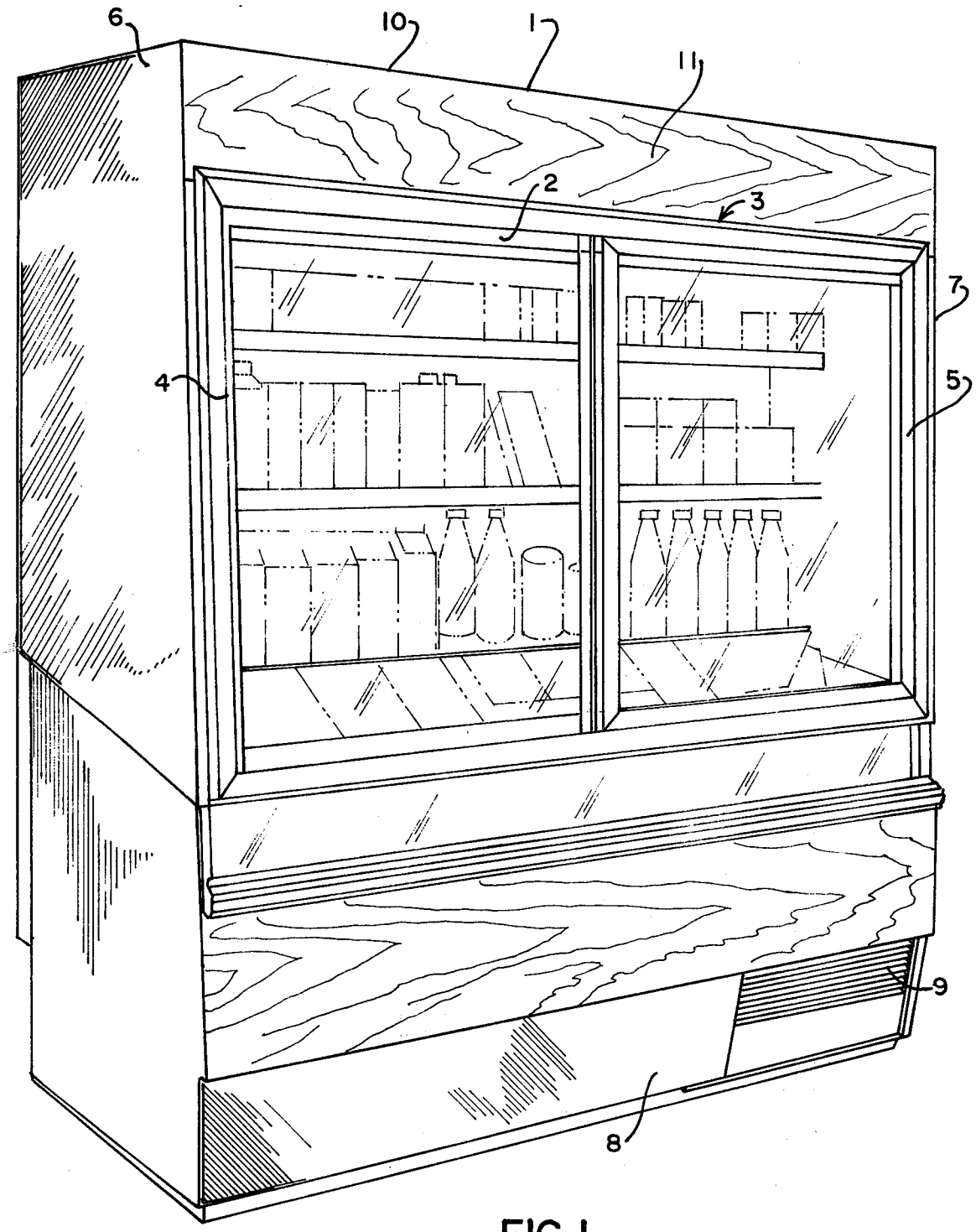
FIG. 1 provides an isometric view of the dual temperature merchandiser of this invention.

As can be seen in FIG. 1, the dual temperature merchandiser of this invention contemplates an upright display case 1 having an access aperture, as at 2, formed through the upper frontal portion of the case, with the aperture extending the full width of the merchandiser so as to provide ample viewing of the products displayed therein. The access aperture may be covered by door means 3, such as the sliding doors 4 and 5, as shown. But, other forms of doors are contemplated for this structure, and could include pivotally opening doors as also frequently found in the refrigerated case merchandising art.

The display case includes a pair of side walls 6 and 7, and a lower front wall 8 with the frontal portion of a vented grill 9 and a slidingly inserted tray 9*a* disposed through the front wall as can be seen, and forming a part of the same wall 8. The upper panel 10 of the front of the case may comprise the grained panel as shown, or more preferably, it may be formed of some translucent material and having advertising display thereon, such as an advertisement that describes the nature of the food products contained within the merchandiser and readily available for selection by the customer.

Figure 2:
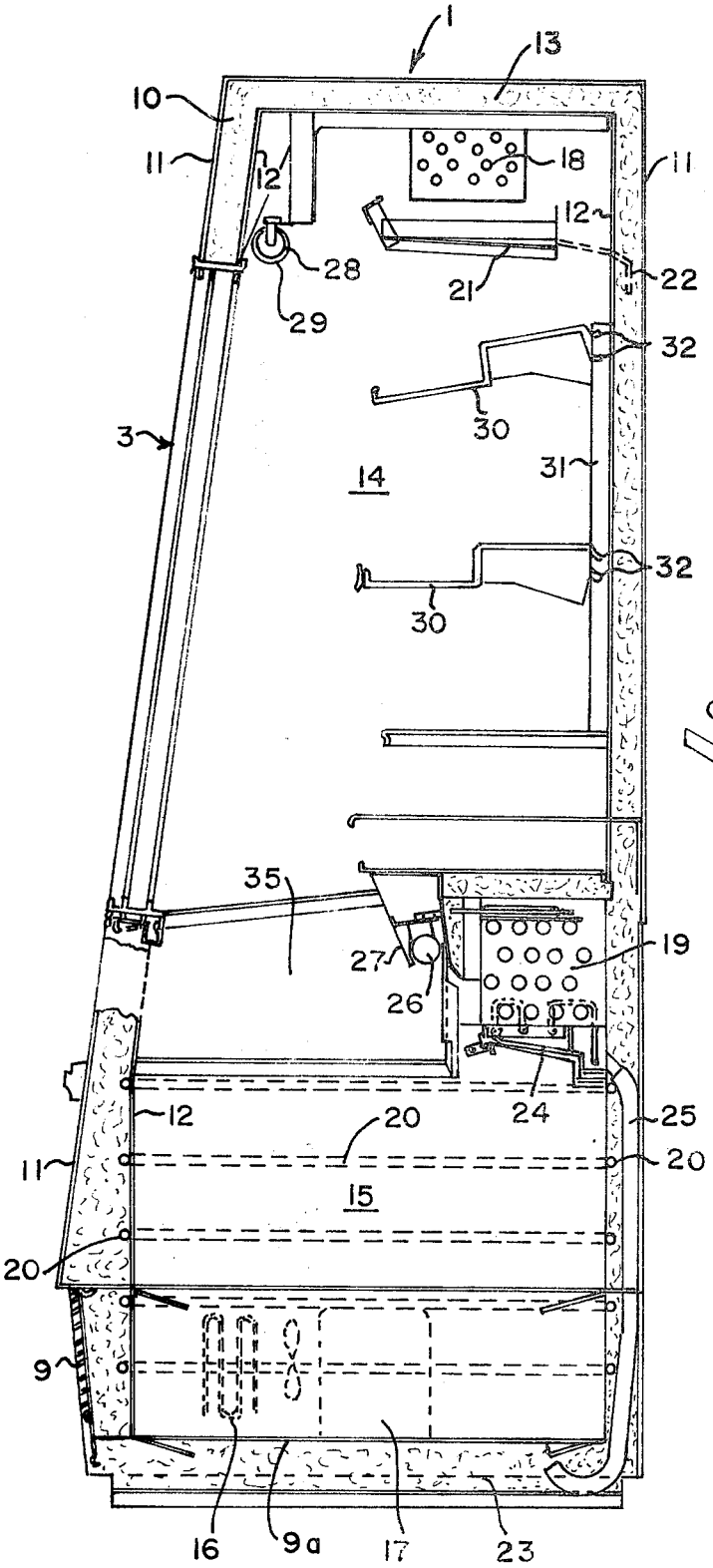
FIG. 2 discloses a vertical sectional view showing the internal physical components of the merchandiser of FIG. 1.

As can be seen in FIG. 2, the case 1 is formed of thin metallic or plastic inner and outer linings, as at 11 and 12, around its periphery, and disposed intermediate thereof is the fiberglas and polyurethane foam insulation 13 as depicted. Such insulation not only adequately provides means for the retention of chilled and freezing air within the merchandiser, but likewise, substantially reduces the cost of fabricating of the case, in addition to adding a pleasing appearance to its internal and external walls. But as just explained, the linings 11 and 12 may be formed of some translucent material, have no insulation therebetween, and thereby allow the light to illuminate any sign provided on the front panel 11. The doors 3, when of the sliding type, may be spring mounted, or even biased towards their normally closed position by means of some form of resilient elastomeric material, such as a band(s) of rubber, which has a tendency to effect a normal closure of the door after it has been opened by the customers, their selection made, and as they walk away from the same. Many times, customers will not spend the moment to close the door of a refrigerated display case, and thus, some means is needed to effect an automatic closure of the same after selection.

The merchandiser of this invention includes an upper compartment 14, and a lower compartment 15, the upper compartment being readily receptive of the normally refrigerated food products such as dairy products, eggs, beverages, packaged meats, pastries, or any other type product that is normally maintained fresh when stored and displayed in an environment of approximately 35° F. On the other hand, the lower compartment is designed for storing and displaying the normally frozen food products, in the category of ice creams, frozen dinners, pastries, pizza, and any other of the novelty type food products, such as popsicles, ice cream bars, sherberts, or the like, and which food products normally are accustomed to retaining their frozen condition when stored within a temperature environment of approximately −10° F. But, as can be seen, both these upper and lower compartments are in natural communication, so that once the customer reaches into the merchandiser, she can select either one of the category of aforesaid food products. At the same time, the cooler air that may be generated within the upper compartment of the case, as upon operations of the refrigeration system, will naturally gravitate towards the lower reaches of the case, or into its lower compartment, so as to insure that the cooler temperatues will be maintained therein, and thus the temperatures within the upper compartment acting as a blanket for assisting in the maintenance of the freezing temperatures normally prevailing within the said lower compartment.

The refrigerating system of this invention has been already analyzed, but it does include the condenser 16 and its coupled compressor 17, both of which are mounted upon the slidable tray **9*a*, thus allowing these two components, and the remaining usual components found in this type of system, to be conveniently and easily slid forwardly to the front of the case as when requiring service by the mechanic. These two refrigerating components are coupled by means of flow tubes with the upper evaporator 18, which is of the gravity type, and which further is mounted in the upper reach of the compartment 14, with the lower evaporator 19 being secured proximate the back wall of the merchandiser, and just at that region between the upper and lower compartments as previously defined. In addition, the lower evaporator also includes a portion of its coils that are maintained in series with the entire evaporator system of this merchandiser and these coils 20 are generally wrapped around the interior surface, or slightly embedded within the walls, of the lower compartment 15, as can be seen. Thus, upon operation of the refrigeration system of this invention, in the selective manner as previously explained in the summary of this invention, the freezing temperatures maintained within the range desired for this lower compartment is adequately assured by the combination of the bundle of evaporator tubes, as at 19, and the coiled tubes 20 which encompass the periphery of the said lower compartment 15**.

Other items included in the structure of this invention comprise the drain pan 21 formed beneath the upper evaporator 18, and which couples with a drain tube 22 for flowing any excess moisture down the back wall of the upper compartment 14, and downwardly to the location of a drain pan (not shown) which is normally disposed proximate the bottom wall 23 of the display case. In addition, another drain pan 24 coupling with the drain tube 25 provides for a conveyance of any moisture generated thereat also towards the drain pan customarily disposed proximate the bottom wall of any refrigerated display case.

In addition, means are provided for adequately illuminating the interior of this merchandiser. This comprises the fluorescence of other form of lighting fixture 26, which generally directs its flood of light downwardly into the lower compartment 15, by means of the reflector 27, and which reflector may also contain a mirrored outer surface, and angulated as shown, so that as the customer looks into the display case she can readily observe the frozen food products maintained in the lower regions of the compartment 15. In addition, lighting means 28 is provided proximate the front upper wall of the merchandiser, above the door means 3, and includes a translucent diffuser or bulb guard 29 that directs light downwardly into the entire display case, and in particular throughout the upper compartment 14. And, as previously explained, the upper front wall panel 10 may not be insulated in the manner as shown in FIG. 2, but rather, this panel may also comprise a separate translucent panel and through which the light from the fixture 28 may glow, and readily display any advertisement imprinted upon the front surface 11 of the display panel 10, which may be used in an alternative manner.

Furthermore, various styles of shelves are provided for use with this invention, and particularly within its upper compartment 14. As can be seen, the shelves 30 are coupled to the rear support 31 which secures to the permanent back wall of the merchandiser, and this support has clearance provided between it, and the permanent back wall of the display case, so that the chilled air emanating from the evaporator 18 may gravitate downwardly between this space and uniformly enter into the upper compartment 14. This support 31 may be perforated, at various locations, so as to allow this newly chilled air to enter into the compartment 14 throughout the heighth of the said wall 31.

Figure 4:
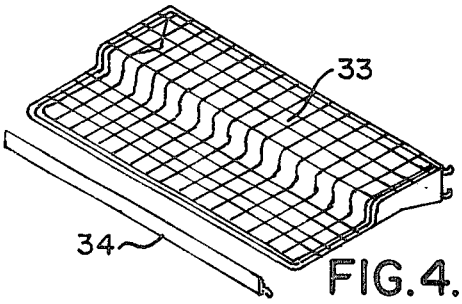
FIG. 4 discloses a modified form of shelf for use within the merchandiser.
Figure 5:
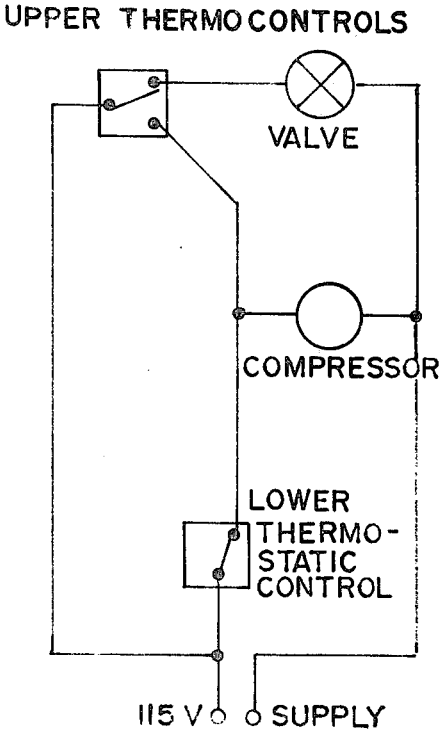
FIG. 5, as previously analyzed, discloses a wiring diagram for the refrigerating unit and its thermostatic controls and valve of this invention.

The shelves 30 may be formed in the manner of trays, as can be seen, with the upper tray 30 having a slight incline, so as to conveniently dispose its supported product to the ready viewing of the customer. In addition, since the back end of these shelves 30 have a series of mounting hooks, as at 32, they may be readily removed from the support 31, and other forms of shelving, such as the wire baskets 33, as shown in FIG. 4, and having a decorative snap on trim 34 provided to its front, may be conveniently and readily replaced within the upper compartment 14, by also hooking onto this support 31. Other forms of shelving is comtemplated for use within this invention, and for example, even a peg bar form of support, such as a bar having a series of pegs directed forwardly thereof, and upon which food products, such as packaged meats and sausages may be suspended, may be used in place of the type of shelving just described. See FIG. 9.

Figure 3:
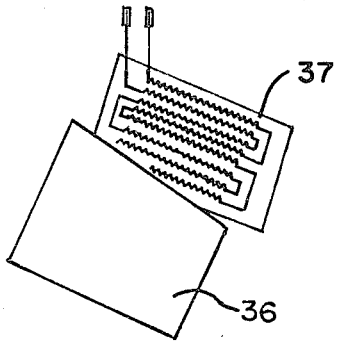
FIG. 3 discloses an exploded view of the frost breaker and its biwalled shield as used within the merchandiser.

Other features built into this invention and which add to the convenience and functional enhancement of its operations include a frost breaker, as at 35, as also shown in FIG. 3, which line the side walls 6 and 7 of the merchandiser, to either side, so as to provide a means for preventing the accumulation of frost at that region of communication between the chilling temperature maintained in the upper compartment 14, and the much colder freezing temperatures pervading within the lower compartment 15. Each frost breaker includes a shield 36, such as constructed of metal or polymer, and disposed therein between the shield and the wall of the cabinet is the heater element 37, which is enveloped between these two structures, when the said shield structure is mounted to the side walls 6 and 7 of the merchandiser as previously explained, and as can be seen. This heater element is to provide for its functioning when too much frost accumulates at this vicinity of the merchandiser.

As can be seen in FIG. 8, a schematic is shown of the flow pattern of the atmosphere that pervades around the interior of this dual temperature merchandiser. For example, the upper evaporator 18, when functioning, is designed to attract the air that may be entering into the merchandiser as when its door means 3 is opened, with the indrawn air passing through the evaporator and being chilled down to a temperature in the vicinity of 35° F., as previously explained. A certain portion of this air will immediately gravitate downwardly and be attracted by means of convection back onto the stream of incoming air, as can be seen, but a further portion of this chilled air will pass downwardly behind the support 31 and gradually attain entrance back into the upper compartment 14 through its natural circulation, as can also be seen. Thus, in this manner, circulation of the chilled air within the upper compartment 14 adequately maintains its temperature within the desired range of 25° F. to 40 ° F., as customarily sought for a food merchandiser for the type of products identified for display within this separate compartment 14. In addition, a certain amount of the air entering into the opened doors of this merchandiser will flow downwardly, and be attracted through the bundle of tubes contained within the lower evaporator 19, with the refrigerated air then dropping further downwardly, after it exits from the evaporator, and generally cascades into the lower compartment 15, as shown. Since a portion of the coils 20 of this lower evaporator surround the inner walls of the lower compartment 15, such coils, when the refrigeration unit is functioning, have a tendency to direct by convection its refrigerated air out into the said lower compartment, thereby providing means for directly sustaining a freezing temperature within the vicinity of 0° F. to −40° F., as customarily sought for a frozen food display case.

In addition, and as previously explained, the chilled air within the upper compartment 14 has a tendency to blanket the refrigerated air maintained within the lower compartment 15 and therefore help to prevent the entrance of too much warm ambient air from the exterior of the merchandiser from entering into the lower compartment 15, and thereby prevent an over working of the refrigeration unit so as to maintain such cold temperatures within this lower disposed compartment.

Various modifications to the construction of this merchandiser, and the method of operation of its refrigeration unit, may occur to those skilled in the art upon reviewing the subject matter of this invention. Such modifications, if within the spirit and scope of the invention, and encompassed by its claims, are intended to be protected by any United States patent issuing upon this invention. The description of the preferred embodiment is set forth for illustrative purposes only.

Having thus described the invention what is claimed and desired to be secured by Letters Patent is:

1. In a dual temperature merchandiser of the type containing a compartment for storage and display of chilled products and another compartment for storage and display of frozen products, the improvement which comprises said compartments being disposed as upper and lower compartments and having full communication therebetween, a single access aperture providing entrance into the two said compartments, openable door means provided for normally closing said access aperture, a single refrigeration means operatively associated with each of said compartments and controlled for maintaining a selected chilling temperature in the upper disposed compartment while providing a selected freezing temperature in the lower disposed compartment, said refrigeration means including a single condenser and compressor, a pair of evaporators operatively associated with said condenser and compressor and receptive of its conveyed refrigerant, one of said evaporators disposed in the higher region of the upper compartment, and the other evaporator being disposed in the lower compartment, valve means operatively connected between the upper and lower evaporators, a pair of thermostatic controls, one of each control arranged in one of each compartment and sensitive to the ambient temperatures maintained therein, the valve means being responsive to the thermostatic control disposed in the upper compartment such that the valve means remains closed and thereby bypassing refrigerant flow through the upper evaporator when a selected chilling temperature is maintained therein, and said valve means opens thereby allowing refrigerant flow through the upper evaporator when the said thermostatic control senses a rise above the said selected chilling temperature within said upper compartment.

2. The invention of claim 1 wherein the thermostatic control in the lower compartment independently controls the operations of the condenser and compressor for inducing refrigerant flow through the evaporator located in the said lower compartment and maintenance of the selected freezing temperature therein.

3. The invention of claim 2 wherein the thermostatic control in the upper compartment independently controls the operations of the condenser and compressor in addition to the opening of the said valve means for inducing refrigerant flow at least through the upper evaporator and maintenance of the selected chilling temperature therein.

4. The invention of claim 2 wherein said evaporator in the lower compartment is formed of a series of coils, and a portion of said coils being maintained proximate the lower compartment walls.

5. The invention of claim 4 wherein the portion of the coils proximate the lower compartment walls are embedded within said walls.

6. The invention of claim 2 wherein the freezing temperature within the lower compartment is maintained between about 0° F. to −40° F. during operation of the said merchandiser.

7. The invention of claim 3 wherein the chilling temperature within the upper compartment is maintained between about 25° F. to 40° F. during operation of the merchandiser.

8. The invention of claim 1 and including a series of shelves provided in the upper compartment projecting from approximately its back wall thereof, therebeing a spacing provided intermediate the said shelves and the said back wall to provide for the flow of chilled air there down and its circulation into the upper compartment for maintaining the selected chilling temperature therein during operation of the said merchandiser.

9. The invention of claim 8 wherein the evaporator disposed in the upper compartment incorporates a gravity type coil.

10. The invention of claim 9 wherein the shelves provided in upper compartment comprise pans.

11. The invention of claim 9 wherein the shelves provided in the upper compartment comprise wire trays.

12. The invention of claim 9 wherein the shelves provided in the upper compartment comprise peg bars.

13. The invention of claim 9 wherein the shelves provided in the upper compartment comprise a combination of pans, wire trays, and peg bars.

14. The invention of claim 13 wherein at least one of said shelves is mounted upon an incline to facilitate its product display.

15. The invention of claim 4 and including a frost breaker provided at the location of communication between the said upper compartment and the lower compartment.

16. The invention of claim 15 wherein said frost breaker is electrically actuated, and is disposed proximate the merchandiser side walls just below the door means of its access aperture.

17. The invention of claim 16 wherein each frost breaker includes an electric heater elements mounted upon the side walls of the said merchandiser, and a cover means enveloping the said heater element.

18. The invention of claim 17 wherein the cover means includes a shield, said shield being connected along its upper edge to the merchandiser side wall, the said shield being disposed over the said heater element and sheltering the same from the interior of the said lower compartment.

19. The invention of claim 18 wherein said shield is formed of metal.

20. The invention of claim 18 wherein said shield is formed of a polymer.

21. The invention of claim 18 wherein said shield is removable to provide access to the said heater element.

22. The invention of claim 4 wherein the walls of the merchandiser compartments include a layer of insulating polymeric foam.

23. The invention of claim 22 wherein said polymeric foam comprises polyurethane.

24. The invention of claim 1 wherein said door means comprises sliding doors.

25. The invention of claim 1 and including light means provided in the upper front region of the upper compartment and above the door means to illuminate the interior of the said merchandiser.

26. The invention of claim 25 and including a diffuser surrounding at least the lower segment of the light means.

27. The invention of claim 26 and including a front panel provided above the door means of the merchandiser, said panel being disposed just forwardly of the said light means, said panel functioning as a lighted display for the said merchandiser upon operation of the said light means.

28. The invention of claim 3 and including a tray provided proximate the bottom of said merchandiser, said tray capable of being drawn out of the said merchandiser, and the condenser, compressor and related refrigerating components being supported upon said movable tray.

29. The invention of claim 28 and wherein said condenser and compressor laden tray are movable out of the front of the said merchandiser.

30. The invention of claim 3 and including drain means associated with one of the walls of the merchandiser and useful for draining the moisture produced at the said evaporators.

* * * * *